US006556174B1

(12) United States Patent
Hamman et al.

(10) Patent No.: US 6,556,174 B1
(45) Date of Patent: Apr. 29, 2003

(54) SURVEILLANCE RADAR SCANNING ANTENNA REQUIRING NO ROTARY JOINT

(76) Inventors: Gary M. Hamman, 5326 E. Voltaire Ave., Scottsdale, AZ (US) 85254; Douglas W. Taylor, 2517 W. Fremont Dr., Tempe, AZ (US) 85252

( * ) Notice: Subject to any disclaimer, the term of this patent is extended or adjusted under 35 U.S.C. 154(b) by 0 days.

(21) Appl. No.: 09/683,266

(22) Filed: Dec. 5, 2001

(51) Int. Cl.[7] ..... H01Q 19/10

(52) U.S. Cl. ..... 343/755; 343/754; 343/757; 343/912

(58) Field of Search ..... 343/754, 755, 343/757, 761, 762, 763, 766, 909, 911 R, 912

(56) References Cited

U.S. PATENT DOCUMENTS 3,848,255 A * 11/1974 Migdal ..... 343/761
4,312,002 A * 1/1982 Stewart ..... 343/725
4,504,835 A * 3/1985 Howard et al. ..... 343/755
4,670,754 A * 6/1987 Zacchio ..... 342/124
H966 H 9/1991 Waters et al. ..... 342/361
6,075,492 A * 6/2000 Schmidt et al. ..... 343/753
6,307,522 B1 * 10/2001 Alexanian ..... 343/781 CA
6,396,448 B1 * 5/2002 Zimmerman et al. ..... 343/753

* cited by examiner

*Primary Examiner*—Don Wong
*Assistant Examiner*—Shih-Chao Chen
(74) *Attorney, Agent, or Firm*—Michael Dryja; Don J. Carnegie

(57) ABSTRACT

A wave-scanning antenna is disclosed that does not require a rotary joint. The antenna produces a collimated beam that can be scanned through 360 degrees. The beam is directed perpendicular to the antenna's axis of rotation to form a disc-like surveillance volume, or at an angle above or below the perpendicular to form a cone-shaped surveillance volume. The radar's structure contains a transmitter and receiver coupled to a horn protruding through open centers of the support bearing and driven gear into the antenna housing. Energy emitted by the horn proceeds upward until deflected through an angle of 90 degrees by an angled reflector located on the axis of rotation. The energy is collected by a dielectric lens and focused into a collimated beam. Reflected energy is collected by the lens and directed by the reflector to the horn, where it is fed to a waveguide coupled to the receiver.

20 Claims, 4 Drawing Sheets

SURVEILLANCE RADAR SCANNING ANTENNA REQUIRING NO ROTARY JOINT

BACKGROUND OF INVENTION

The present invention relates in general to continuous rotation scanning antennas for use in surveillance radars, and in particular to a scanning antenna configuration that does not require the use of a rotary joint.

The possibility of terrorist activity, compromise of military information, or material theft results in the need to protect various high value assets whether located in permanent or temporary sites. A desirable approach protecting such valuable assets is the establishment of a network of low power surveillance radars to provide automated perimeter security. For greatest versatility, the surveillance radars should be easily transportable and deployable in multiple emplacements in any desired positional configuration. Therefore, the surveillance radar should be small in size and have a weight low enough for single person installation.

A typical example of a multiple surveillance radar deployment is shown in FIG. 1. An aircraft parking area 1 containing high value assets, such as aircraft 2, is encompassed by a multiplicity of surveillance radars 3 spaced so that the detection volumes 4 provided by each radar form a continuous zone for the detection of intruders around the perimeter of the area 1. The cost of such an installation should be affordable, and thus each surveillance radar should be designed and constructed in a manner to minimize cost while providing the required performance. The surveillance radars should provide an azimuthal scan of 360 degrees to allow for versatility of placement, and a scan rate sufficiently high that an intruder cannot traverse the radar's detection volume without being intercepted by a scan of the beam and thus detected. Operation in the millimeter wave region of the electromagnetic spectrum allows the use of a small, lightweight-scanning antenna that produces a narrow beam in azimuth for adequate resolution of target details.

The prior art employs various methods in the design of continuous rotation, 360-degree scan antenna systems, especially for microwave radars. To accomplish focusing of the transmitted beam, the antenna can employ either a parabolic reflecting element or a refracting element with a microwave feed located at the focal point of the element, a planar array made up of slotted waveguides, or equivalent electromagnetic structure, etc. One common technique for coupling the microwave signals from the antenna to the transmitter and receiver subelements is to place these subelements in the stationary portion of the radar. The transmitted and received signals are transferred to and from the antenna by a rotary joint placed upon the axis of rotation of the antenna.

Another technique is to locate much or all of the transmitter and receiver subelements with the antenna on the rotating structure, and transfer raw power and control signals from, and receiver output video to the stationary portion of the radar via slip rings coupled to the rotational axis. This technique has disadvantages of significant transmitter/receiver weight forming part of the rotating mass, a relatively uncontrolled environment for critical transmitter/receiver circuitry, and signal noise generated by the slip ring assembly.

The first described technique using a rotary joint is generally preferable. Rotary joints operating in the microwave region of the electromagnetic spectrum are widely used and provide adequate performance. However, those that operate in the millimeter wave region of the spectrum may not provide adequate performance and are prohibitively expensive for use in a low cost surveillance radar.

One example of prior art is the reference Waters et al., statutory invention reg. no. H966, published on Sep. 3, 1991. Waters provides a scanning antenna requiring no rotary joint for use in a shipboard environment. In the stationary portion of this design, the electromagnetic energy is collimated into a beam of significant diameter by means of a parabolic reflector. This beam is transmitted upward to a rotating assembly that by phase sensitive reflection produces two scanning, orthogonally polarized beans transmitted horizontally in opposite directions. The physical mechanism that supports the scanning assembly must provide unobstructed passage of the rather large diameter collimated beam from the stationary parabolic reflector to the rotating assembly.

In view of the above, there is a need for an improved method of transferring the millimeter wave electromagnetic energy between the rotating antenna and the transmitter and receiver subelements located in the stationary portion of the radar. Furthermore, there is a need to accomplish this without requiring the use of slip rings or a rotary joint, and by using a minimum of components in a lightweight configuration having reasonable cost. For these and other reasons, there is a need for the present invention.

SUMMARY OF INVENTION

The invention relates to a surveillance radar-scanning antenna requiring no rotary joint. The surveillance radar antenna of the invention includes a millimeter wave horn positioned on the vertical axis of rotation of the antenna and protruding through the open center of the antenna support bearing, driven gear, and a hole in the antenna housing. Divergent millimeter wave electromagnetic energy is emitted vertically by the non-rotating horn, then is deflected to the horizontal by an angled reflector before being focused by a dielectric lens into a collimated beam. The rotating antenna housing supports the angled reflector and dielectric lens. Provisions are made for vertical positioning of the dielectric lens to allow limited adjustment of the transmitted beam above or below the horizontal. Received energy reflected from distant targets is collected by the dielectric lens and directed by the angled reflector to the non-rotating horn where it is fed to a waveguide coupled to the receiver.

The present invention provides a method for the transfer of millimeter wave electromagnetic energy between a rotating antenna assembly and the transmitter and receiver subelements in the stationary structure of the radar. An advantage of the present invention is that a millimeter wave rotary joint, with its intrinsic requirement for extremely accurate tolerances and highly expensive manufacturing processes, is not required. Another advantage is that a surveillance radar incorporating the present invention does not have any moving mechanical parts in the waveguide portion of the electromagnetic energy path. Furthermore, the radar of the invention experiences no variation in energy loss due to variations in a mechanical rotary joint, and does not require the periodic replacement of an expensive rotary joint component.

In contrast to Waters, the present invention uses a support bearing and driven gear, which supports and drives the rotating antenna structure, with open inner diameters only sufficiently large to allow passage of a non-rotating millimeter wave waveguide assembly. The electromagnetic beam is emitted by a non-rotating horn and then collimated by an angled reflector and dielectric lens forming a part of the rotating portion of the antenna. Other aspects, embodiments, and advantages of the prior art will become apparent by reading the detailed description that follows, and by referring to the accompanying drawings.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 2:
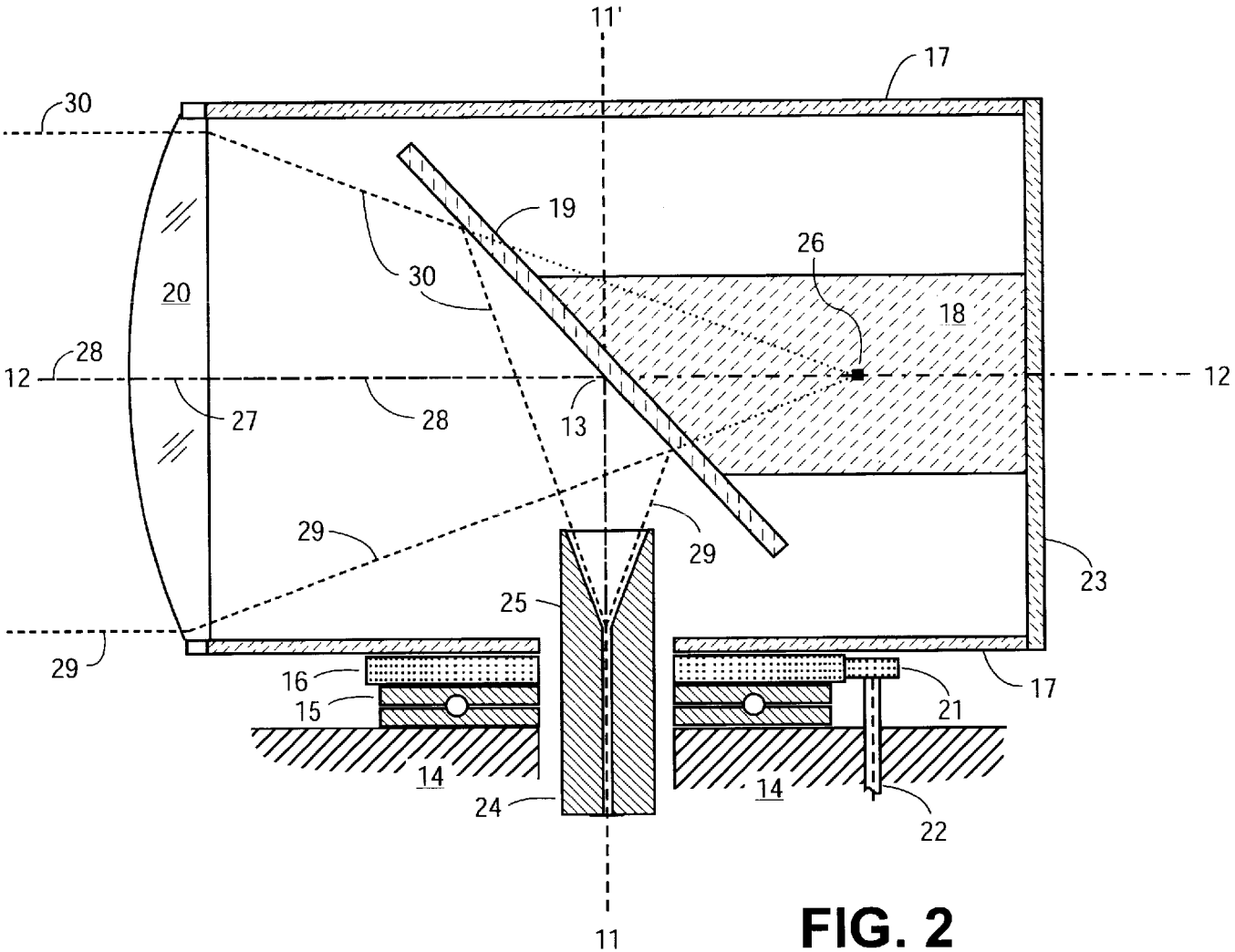
FIG. 2 is a cross-sectional view of a rotating antenna structure that does not require a rotary joint.

The configuration of major components of a rotating antenna according to one embodiment of the invention is depicted in cross sectional view in FIG. 2. Major components are positioned axially along two major axes 11–11' and 12–12' which are perpendicular to each other and intersect at point 13. Stationary structure 14 contains the transmitter, receiver and signal processor subelements of the radar, and provides support for the rotating portion of the antenna.

The rotating portion of the antenna includes the upper portion of support bearing 15, driven gear 16, housing 17 and its included components, reflector support 18, reflector 19 and lens 20. Lens 20 is fabricated of a dielectric material having the capability of reducing the propagation velocity of millimeter wave electromagnetic energy while passing it with essentially no attenuation. The lower portion of support bearing 15 is rigidly coupled to the stationary structure 14 while its upper portion is rigidly coupled to the driven gear 16 which is in turn rigidly coupled to housing 17. Support bearing 15, and driven gear 16 and a hole in the lower portion of housing 17 are located coaxially along axis 11–11'. This rotating assembly revolves about axis 11–11', being rotationally driven by drive gear 21 which is coupled to driven gear 16. Drive gear 21 is coupled to a drive motor, which is not shown, by shaft 22.

Housing 17 has the form of a cylinder, seen in cross sectional view in FIG. 2, with its axis being defined by axis 12–12'. The cylinder is terminated at one end by lens 20 and at the other by housing end plate 23. Included within the housing is a reflector 19 coupled to a reflector support 18 that is in turn coupled to the housing end plate 23. Reflector 19 is supported so that its front reflecting surface coincides with the intersection of axes 11–11' and 12–12' at point 13, and the plane of reflector 19 is tilted to form angles of substantially 45 degrees with respect to both axes 11–11' and 12–12'.

Millimeter wave feed and horn structure 24, comprising a circular waveguide coupled to a conical horn, is coaxially positioned along axis 11–11' so that it protrudes through the open inner diameters of support bearing 15, driven gear 16 and the hole located in the bottom of housing 17. Point 25 defines the apparent point of origin of millimeter wave electromagnetic rays emanating from the horn. Lens 20 has a finite thickness that must be considered for highly accurate determination of the paths of electromagnetic rays passing through the lens. However, for first order analysis, a point 27 can be defined which will approximate the location of an imaginary lens having equivalent focusing performance but zero thickness. The feed and horn structure 24 is positioned along axis 11–11' so that the distance along axis 11–11' from point 25 to point 13 plus the distance along axis 12–12' from point 13 to point 27 is essentially equal to the focal length of lens 20 at the frequency of operation. Millimeter wave feed and horn structure 24 is physically coupled to the stationary structure 14 and maintains a constant position as the rotating portion of the antenna rotates about axis 11–11'.

The preferred embodiment of the present invention operates at a frequency of substantially 35.5 Gigahertz. Housing 17 has outer and inner dimensions of substantially 16.5 and 15.2 centimeters respectively; its overall length is defined by the appropriate spacing of lens 20 with respect to reflector 19 and a selected length of reflector support 18 to provide equal mass distribution of the housing and its coupled components fore and aft of axis 11–11'. The horn portion of the horn and feed structure 24 is an axisymmetric conical structure having a cone half angle of substantially 24 degrees with respect to axis 11–11', and having a length of substantially five centimeters from apex to aperture. The horn is fed by a circular waveguide having an internal diameter optimized to the frequency of operation by the use of principles well known to those skilled in the art.

Reflector 19 is fabricated of Aluminum or similar material being highly reflective of millimeter wave energy and has reflecting surface dimensions that exceed the area impinged by the electromagnetic energy emanating from the horn. The reflector surface finish and flatness are several orders of magnitude less than the wavelength the reflected millimeter waves. Lens 20 has a piano-convex form being fabricated of a polypropylene dielectric material, and has an aperture and focal length of substantially 15.2 and 17.8 centimeters respectively. The combined distances from points 25 to 13 and from 13 to 27 are adjusted to be effectively equal to the focal length of lens 20. The angles of reflector 19 with respect to axes 11–11' and 12–12' causes the apparent point of origin of rays emanating from the horn, point 25, to appear to be located at point 26 on axis 12–12' when viewed from the position of lens 20. Adjusting the vertical position of horn and feed structure 24 can be accomplished to optimize the focus of the beam emanating from lens 20. After adjustment, its position is fixed with respect to the stationary structure 14.

In transmit operation, millimeter wave electromagnetic energy proceeds up the circular waveguide portion of the horn and feed structure 24 to point 25 and then is dispersed into a conical volume by the horn. Each elemental segment of this energy forms a ray that proceeds from the horn appearing to have come from point 25, until it impinges upon reflector 19 to be reflected in accordance with well known laws of reflection from a flat reflective surface. Upon leaving the surface of reflector 19, the solid cone of electromagnetic rays proceeds to the rear surface of lens 20. While passing through the dielectric lens the rays are focused into a substantially collimated beam having an initial diameter essentially equal to the aperture of lens 20, or 15.2 centimeters. A central ray 28 proceeds from point 25 along axis 11–11' until reaching reflector 19 at point 13, next proceeds to point 27 located in lens 20, and then passes through the center of the lens undeviated continuing along a path that is an extension of axis 12–12'. The path of this central ray 28 defines the direction of propagation of the beam formed by the antenna.

Ray 29 and ray 30 are peripheral rays defined by the maximum aperture limit of lens 20. After being reflected by reflector 19, these rays appear to have originated at point 26 and proceed to the lower and upper regions of lens 20. They are then diffracted by their angles of incidence with respect to the first surface and the curvature of the lens at the points of ray exit in accordance with the dielectric constant of the lens and the well-known Snell's law. The paths of rays 29 and 30 proceeding from the lens are substantially parallel to that of the central ray 28. Although FIG. 2 is a two-dimensional depiction of that vertical plane which contains both axes 11–11' and 12–12', those skilled in the art will recognize that reflecting surface 19 is a two-dimensional surface, lens 20 has a circular aperture, and that rays emanating from point 25 will, after reflection from reflecting surface 19, substantially fill the planer aperture of lens 20. The electromagnetic energy exiting lens 20 has the form of a collimated beam, with diameter essentially the same as the aperture of the lens. Factors such as spherical aberration and manufacturing tolerances of low cost dielectric lenses result in some spreading of the emitted beam. One example of the preferred embodiment provided a transmitted beam width of some 3.6 degrees.

During receive operation, a portion of the transmitted beam is reflected from the target back to the antenna where the received energy impinging upon the lens 20 follows essentially a reverse path through the antenna until it arrives at point 25 and proceeds down the circular waveguide to the receiving subsystem within the stationary structure 14. The described configuration produces a linearly polarized beam with the polarization rotating as the antenna structure sweeps through a 360-degree search pattern. Both analysis and experiment have shown that the area illuminated on targets of interest by the radar beam typically has a surface roughness significantly exceeding a half wavelength of the operational frequency, which is some 4.2 millimeters. Therefore, the rotating polarized beam has no effect on overall radar performance.

Figure 1:
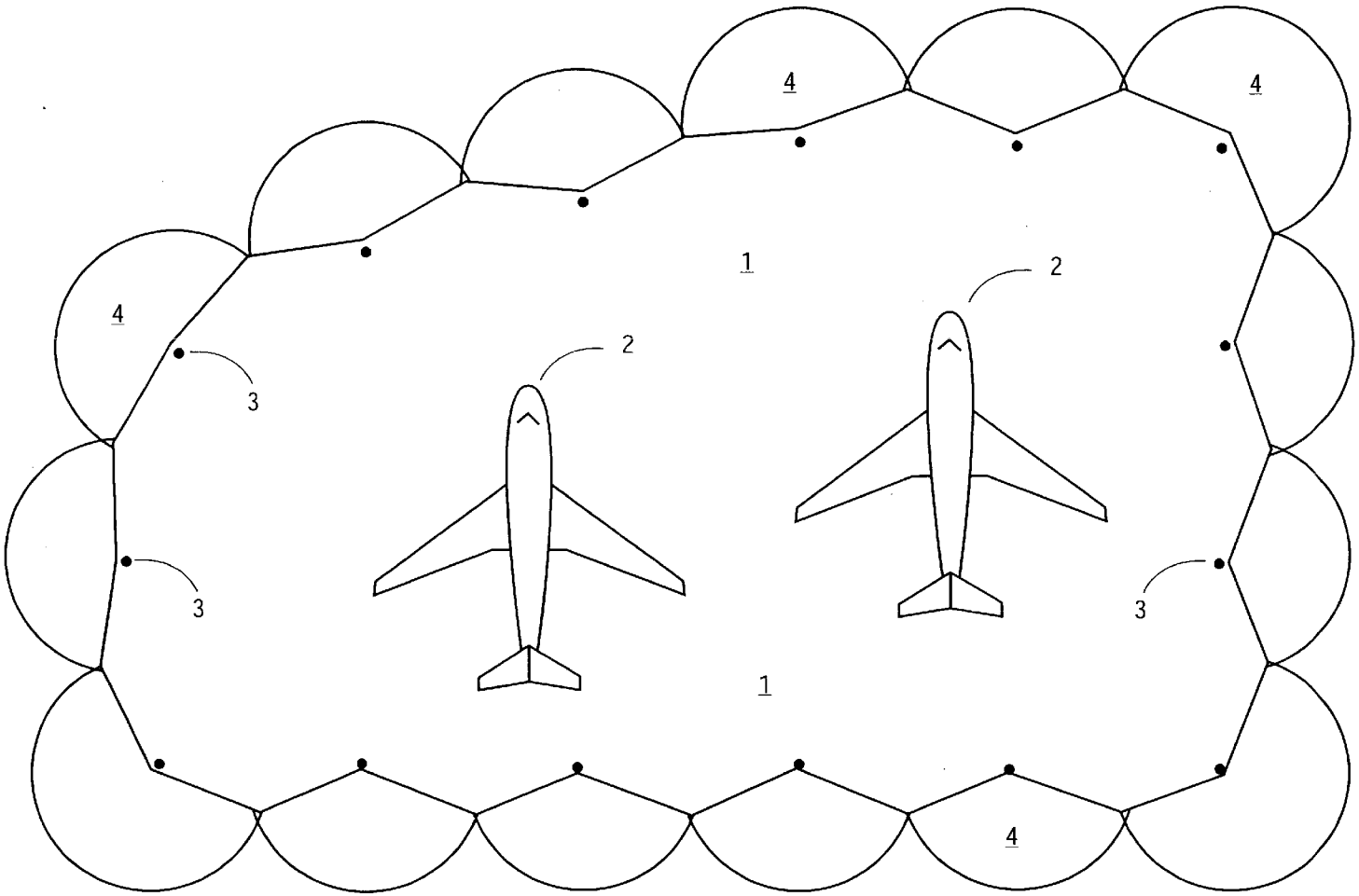
FIG. 1 illustrates an electronic fence made up of a multiplicity of radars to protect high value assets.

When deploying a multiplicity of radars incorporating the present invention in configurations similar to that shown in FIG. 1, it may be found that the terrain is not flat and thus it may be necessary to place a radar in a depression or at the top of a knoll with the requirement that the radar maintain surveillance of the area surrounding its position. The antenna configuration shown in FIG. 2 produces a beam pattern having the form of a horizontal disc with the radar rotating antenna at its center. If deployed at the bottom of a depression, the search range would be limited due to the radar beam impinging upon the sides of the depression a short distance away from the radar. If placed on a knoll, the disc-like beam pattern would be located progressively further above the surface as the distance from the radar increased, possibly allowing an intruder to crawl under the beam. Such situations make it highly desirable to adjust the antenna so that the path of the beam will be either above or below the plane formed by the rotation of axis 12–12' about axis 11–11'.

Figure 3:
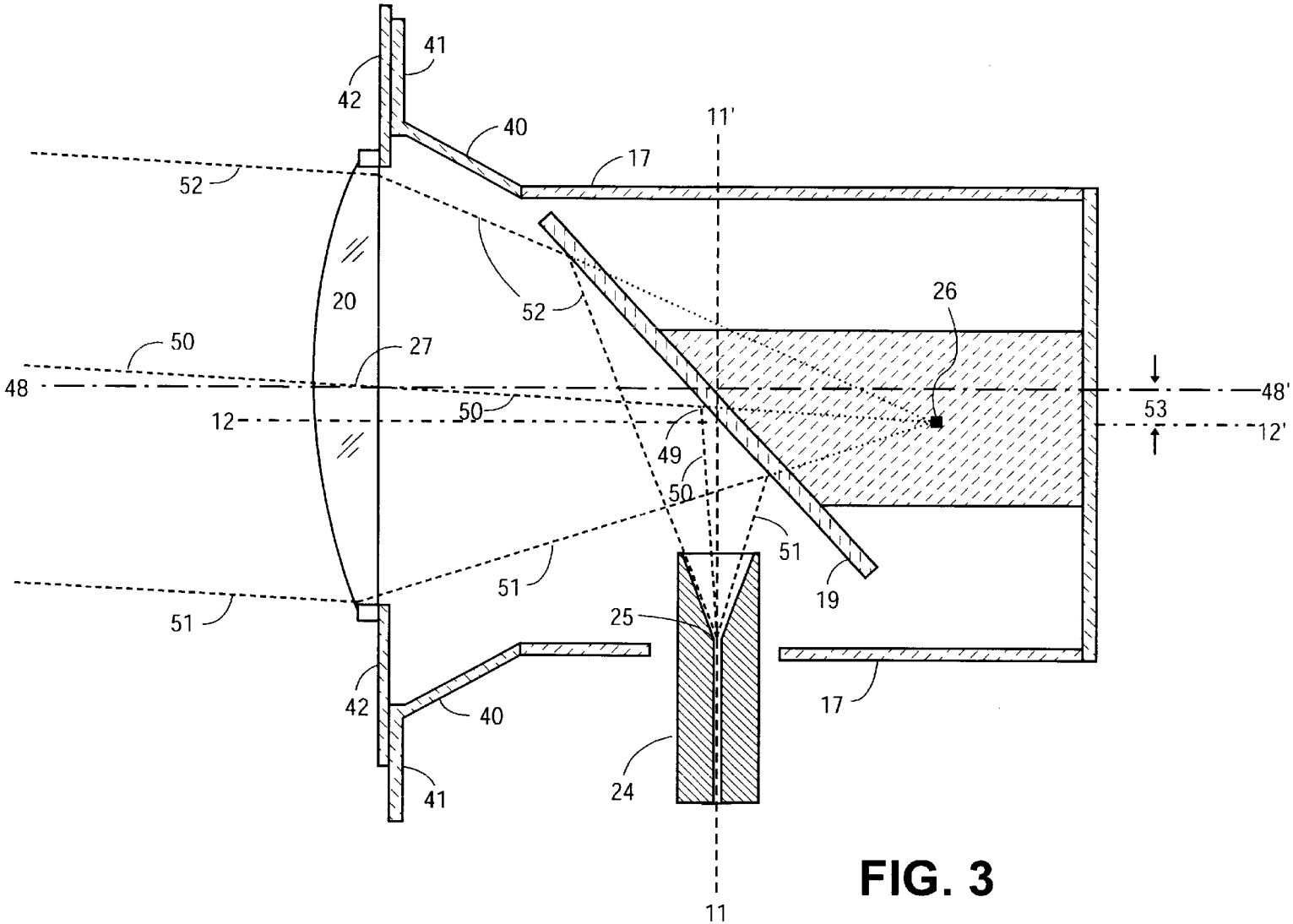
FIG. 3 shows a cross-sectional view of an alternate configuration of the rotating antenna structure with provisions added to allow vertical adjustment of the dielectric lens position for the purpose of aiming the transmitted beam above or below the horizontal.
Figure 4:
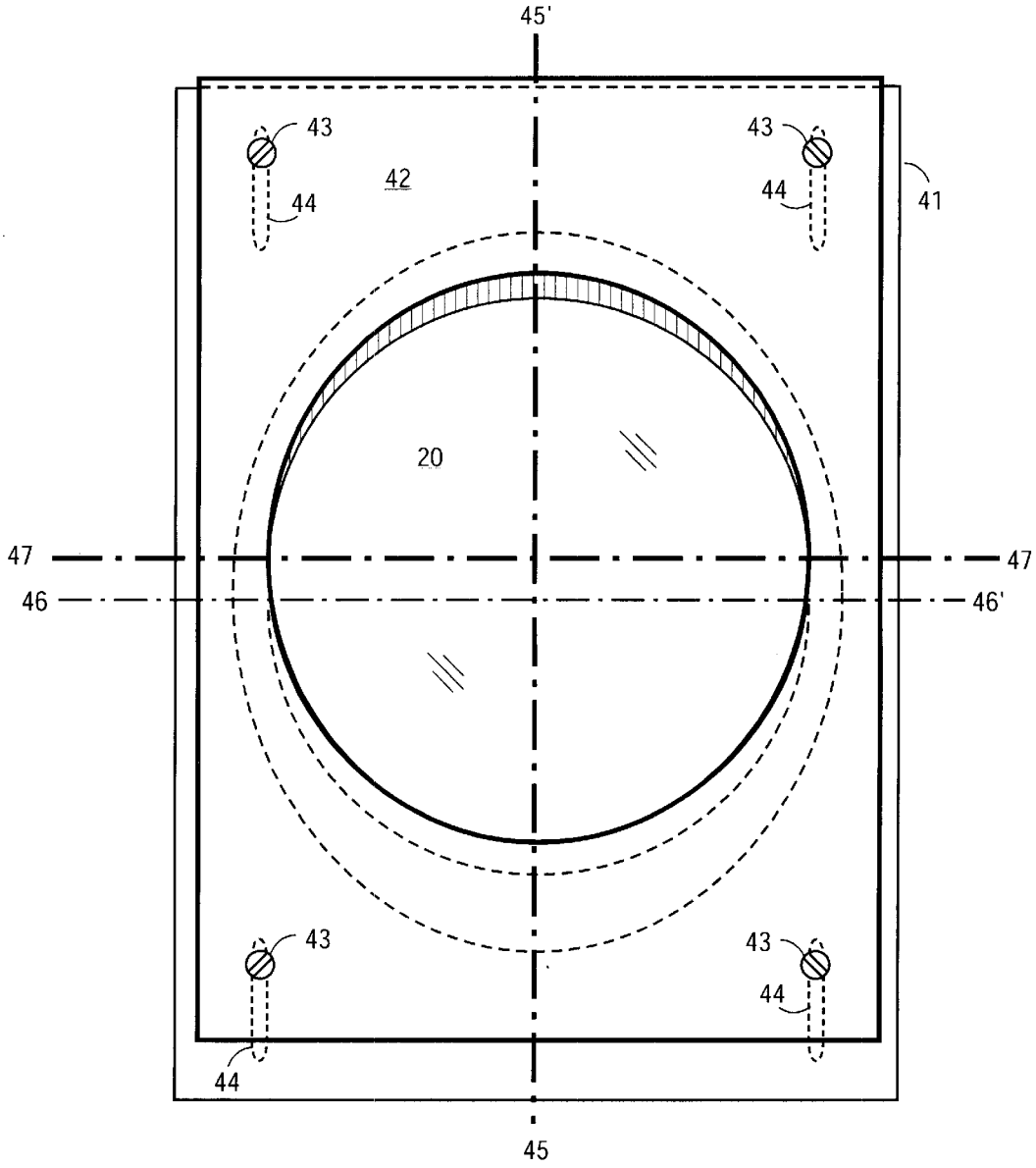
FIG. 4 is a frontal view of the alternate configuration with the lens support plate in the foreground and the antenna housing in the background.

FIG. 3 presents an alternate configuration for housing 17 and the coupling of the lens 20 thereto. A portion of the cylindrical housing nearest the lens is replaced with a conical section 40 that is coupled to a mounting plate 41. FIG. 4 shows a front view of the alternate configuration with the mounting plate 41 in the background and a lens support plate 42 in the foreground. Lens 20 is coupled to the lens support plate 42 that is held in position against the mounting plate 41 by four fasteners 43. Four slots 44 located in the mounting plate 41 and four holes for the fasteners similarly located in the lens support plate 42 allow fasteners 43 to be used to couple the lens support plate to the mounting plate in a range of vertical positions with respect to the cylindrical axis of the housing 17. A vertical axis 45–45' passes through the center of the lens 20 and is parallel to the axis 11–11', about which the antenna rotates. A horizontal axis 46–46' is coincident with and orthogonal to the axis 12–12' and defines the vertical center of the housing 17. A horizontal axis 47–47'passes through the center of the lens 20 and can occupy any of a number of positions above, on, or below the axis 46–46', with its limits defined by the extent of the positions of the fasteners 43 in the slots 44. The lens 20 is positioned above the axis 46–46' in both FIGS. 3 and 4. An axis 48–48', seen in FIG. 3, is orthogonal to both axes 45–45' and 47–47', and is parallel to the axis 12–12'.

In FIG. 3, the position of the lens 20 has been raised with respect to that which it occupied in FIG. 2. No changes have been made in the positions of the feed and horn structure 24 or reflector 19; therefore, the apparent point of origin of rays emanating from the horn, point 25, continues to appear to be located at point 26 on axis 12–12' when viewed from the position of the lens 20. A ray 50 can be traced from point 25 to point 49 on the reflector 19 where its path is reflected toward point 27 at the center of the lens 20 in accordance with the laws of reflection well known to those skilled in the art. A ray 50 passes through the center of the lens 20 undeviated and proceeds from the lens making a small positive angle with respect to the axis 48. Note that the ray 50 can be considered to have come from point 26, proceeding in a straight line through points 49 and 27 toward distant targets.

Peripheral rays 51 and 52 are defined by the maximum aperture of the lens 20. After being reflected by the reflector 19, these rays appear to have originated at point 26 and proceed to the lower and upper regions of the lens 20 where they are diffracted by the dielectric constant of the lens and the ray angles of incidence with respect to the first surface and the curvature of the lens at the points of ray exit. The paths of rays 51 and 52 proceeding from the lens are substantially parallel to that of the central ray 50. Although FIG. 2 is a two-dimensional depiction of that vertical plane which contains the axes 11–11', 12–12', and 48–48', those skilled in the art will recognize that the reflecting surface 19 is a two-dimensional surface, the lens 20 has a circular aperture, and that rays emanating from point 25 will, after reflection from the reflecting surface 19 substantially fill the planer aperture of the lens 20. The electromagnetic energy exiting the lens 20 has the form a collimated beam, with diameter essentially the same as the aperture of the lens.

The axis 48–48' is parallel to the axis 12–12' with the separation between them being defined by a distance 53. When the distance 53 is not zero, the angle that the radar beam makes with respect to a horizontal plane is approximately given by Beam angle=arctan (distance 53/lens 20 focal length). In the preferred embodiment of the present invention, slots 44 have a length sufficient to provide an adjustment range of the distance 53 of plus and minus 1.5 centimeters that allows elevating or depressing the beam angle by a maximum of approximately five degrees.

It is noted that, although specific embodiments have been illustrated and described herein, it will be appreciated by those of ordinary skill in the art that any arrangement is calculated to achieve the same purpose may be substituted for the specific embodiments shown. For instance, the values presented above in conjunction with FIGS. 2, 3, and 4 describe one embodiment of the present invention. Those skilled in the art will recognize that equivalent performance will be provided by operation at other wavelengths, and in particular at some 76 Gigahertz, and with other dimensions for the various components. A rectangular waveguide and horn structure can also be used in lieu of the circular structures. This application is intended to cover any adaptations or variations of the present invention. Therefore, it is manifestly intended that this invention be limited only by the claims and equivalents thereof.

What is claimed is:

1. An apparatus for use in directing a collimated electromagnetic beam to any heading within a disc-shaped volume, the disc-shaped volume formed by scanning of the collimated electromagnetic beam through 360 degrees about a center of the disc-shaped volume, comprising:

a stationary structure;

a housing coupled to the stationary structure such that the housing is rotatable about a rotational axis, the rotational axis being fixed perpendicular to a surface of the stationary structure, the housing having a longitudinal axis intersecting the rotational axis and extending perpendicular to the rotational axis, a continuous void axially centered on the rotational axis and extending from within the stationary structure to within the housing;

an emitter and receiver coupled to the stationary structure, located on the rotational axis, and protruding through the continuous void, the emitter capable of emitting electromagnetic energy and the receiver responsive to the electromagnetic energy;

a reflecting surface located within the housing at the intersection of the rotational axis and the longitudinal axis and rigidly coupled to the housing, the reflecting surface positioned at an angle of substantially 45 degrees with respect to the rotational axis and capable of deflecting the emitted electromagnetic energy through a directional change of substantially 90 degrees; and, a focusing mechanism coupled to the housing and axially centered on the longitudinal axis, the focusing mechanism capable of collecting the emitted electromagnetic energy and focusing the emitted electromagnetic energy into a beam axially centered about an extension of the longitudinal axis.

2. The apparatus of claim 1, wherein the electromagnetic energy emitted by the emitter is in a cone-shaped volume within the housing and axially centered on the rotational axis.

3. The apparatus of claim 2, wherein the electromagnetic energy after reflection is axially centered about the longitudinal axis.

4. The apparatus of claim 1, wherein the focusing mechanism is capable of bi-directional processing of the electromagnetic energy.

5. The apparatus of claim 1, wherein the housing is coupled to the stationary structure by a coupling mechanism.

6. The apparatus of claim 5, wherein the coupling mechanism comprises:

a support bearing coupled to the stationary structure and axially positioned about the rotational axis, the support bearing having a circular void through its center, the circular void being axially centered on the rotational axis; and, a driven gear coupled to the support bearing and to the housing, the driven gear being axially positioned about the rotational axis and having a circular void through its center, the circular void being axially centered on the rotational axis.

7. The apparatus of claim 1, wherein the continuous void comprises:

a void in the surface of the stationary structure being aligned with the void in the support bearing; and, a void in the surface of the housing being aligned with the void in the driven gear, where the voids in the surface of the stationary structure, the support bearing, the driven gear and the housing are of similar diameter and axially centered about the rotational axis.

8. The apparatus of claim 1, wherein the emitter and receiver comprise:

a millimeter waveguide coupled to a source of millimeter wave electromagnetic energy and to a receiver capable of extracting target information from received millimeter wave signals; and, a millimeter wave horn coupled to the millimeter waveguide and being capable of emitting and collecting millimeter wave electromagnetic energy, and transferring the energy from and to the millimeter waveguide.

9. The apparatus of claim 1, wherein the focusing mechanism comprises a lens having a positive focal length and being fabricated of a dielectric material having the capability of reducing the propagation velocity of millimeter wave electromagnetic energy while passing it with essentially no attenuation.

10. The apparatus of claim 9, wherein the lens is fabricated of a polypropylene dielectric material.

11. An apparatus for use in directing a collimated electromagnetic beam to any heading within a volume formed between two adjacent conical surfaces, the two adjacent conical surfaces being defined by upper and lower extent of the collimated electromagnetic beam as the beam is scanned through 360 degrees about a rotational axis, comprising:

a stationary structure;

a housing coupled to the stationary structure by a coupling means allowing the housing to rotate about the rotational axis, the rotational axis being fixed perpendicular to a surface of the stationary structure, the housing having a longitudinal axis intersecting the rotational axis and extending perpendicular to the rotational axis;

a continuous void axially centered on the rotational axis, the continuous void extending from within the stationary structure through the coupling means to within the housing;

an emitting and receiving means coupled to the stationary structure, located on the rotational axis, and protruding through the continuous void, the emitting and receiving means capable of emitting electromagnetic energy into a cone shaped volume within the housing with the cone shaped volume being axially centered on the rotational axis, and the emitting and receiving means responsive to electromagnetic energy within the cone shaped volume that is propagating toward the emitting and receiving means;

a reflecting surface located within the housing at the intersection of the rotational axis and the longitudinal axis being rigidly coupled to the housing, the reflecting surface positioned at an angle of substantially 45 degrees with respect to the rotational axis and capable of deflecting the emitted electromagnetic energy through a directional change of substantially 90 degrees, after reflection the cone shaped volume of emitted electromagnetic energy being axially centered about the longitudinal axis;

a focusing means being axially centered on a focusing means axis and capable of collecting the emitted electromagnetic energy in the cone shaped volume and focusing the emitted electromagnetic energy into a collimated beam, the focusing means capable of bi-directional processing of electromagnetic energy; and, an adjustable coupling means for coupling the focusing means to the housing and capable of fixing the position of the focusing means axis parallel to the longitudinal axis and at any of multiple positions further away or closer to the surface of the stationary structure than the position of the longitudinal axis.

12. The apparatus of claim 11, wherein the coupling means for coupling the stationary structure to the housing comprises:

a support bearing coupled to the stationary structure and axially positioned about the rotational axis, the support bearing having a circular void through its center, the circular void being axially centered on the rotational axis; and, a driven gear coupled to the support bearing and to the housing, the driven gear being axially positioned about the rotational axis and having a circular void through its center, the circular void being axially centered on the rotational axis.

13. The apparatus of claim 11, wherein the continuous void comprises:

a void in the surface of the stationary structure being aligned with the void in the support bearing;

a void in the surface of the housing being aligned with the void in the driven gear;

and the voids in the surface of the stationary structure, the support bearing, the driven gear and the housing being of similar diameter and axially centered about the rotational axis.

14. The apparatus of claim 11, wherein the emitting and receiving means comprises:

a millimeter waveguide coupled to a source of millimeter wave electromagnetic energy and to a receiver capable of extracting target information from received signals;

and a millimeter wave horn coupled to the millimeter waveguide and being capable of emitting and collecting millimeter wave electromagnetic energy, and transferring the energy from and to the millimeter waveguide.

15. The apparatus of claim 11, wherein the focusing means comprises a lens having a positive focal length and being fabricated of a dielectric material having the capability of reducing the propagation velocity of millimeter wave electromagnetic energy while passing it with essentially no attenuation.

16. The apparatus of claim 15, wherein the lens is fabricated of a polypropylene dielectric material.

17. The apparatus of claim 11, wherein the adjustable coupling means comprises:

a flange coupled to the housing having an opening axially centered about the longitudinal axis, the opening larger than the aperture of the focusing means, the flange having a flat outer surface normal to the longitudinal axis and having a multiplicity of slots through the flange symmetrically positioned at locations on the outer surface, the slots running parallel to the plane formed by the rotational axis and the longitudinal axis;

a support plate coupled to the outer diameter of the focusing means having a mating surface compatible with the flat outer surface of the flange, and having circular holes positioned to match the locations of the slots and to cause the focusing means axis to be coincident with the longitudinal axis when the circular holes align with the center of the slots;

and adjustable fasteners compatible with and passing through the holes and the slots to fix the relative position of the support plate with respect to the flange, thus allowing selection of any position for the focusing means within the limits of the slots.

18. An apparatus for use in directing a collimated electromagnetic beam to a heading within a disc-shaped volume formed by scanning of the collimated electromagnetic beam about a center of the disc-shaped volume, comprising:a stationary structure;a housing coupled to the stationary structure such that the housing is rotatable about a rotational axis;an emitter and receiver coupled to the stationary structure on the rotational axis, the emitter capable of emitting electromagnetic energy and the receive responsive to the electromagnetic energy; a reflecting surface on the housing on the rotational axis and capable of deflecting the electromagnetic energy emitted through a directional change; and, a focusing mechanism coupled to the housing and capable of collecting and focusing the electromagnetic energy emitted into a beam.

19. The apparatus of claim 18, wherein the housing further has a longitudinal axis intersecting the rotational axis and extending perpendicular to the rotational axis.

20. The apparatus of claim 19, wherein the reflecting surface is on the housing at an intersection of the rotational axis and the longitudinal axis, and the beam is axially centered about the longitudinal axis.

* * * * *